US006189183B1

(12) United States Patent
Hartselle, III

(10) Patent No.: US 6,189,183 B1
(45) Date of Patent: Feb. 20, 2001

(54) SANITARY DOOR OPENER WITH BUMPER

(76) Inventor: William Hartselle, III, 15 Woodland Trail, Newnan, GA (US) 30263

( * ) Notice: Under 35 U.S.C. 154(b), the term of this patent shall be extended for 0 days.

(21) Appl. No.: 09/406,991

(22) Filed: Sep. 28, 1999

Related U.S. Application Data

(63) Continuation-in-part of application No. 08/915,500, filed on Aug. 20, 1997, now Pat. No. 5,983,454.

(51) Int. Cl.[7] ..... A47B 95/20
(52) U.S. Cl. ..... 16/412
(58) Field of Search ..... 16/412, 110 R, 16/111 R, 114 R; 292/347; 49/460; 294/26, 51; D8/307, 300, DIG. 1

(56) References Cited

U.S. PATENT DOCUMENTS

| | | | | |
|---|---|---|---|---|
| 842,081 | | 1/1907 | Clark . | |
| 1,245,216 | | 11/1917 | Gohlke . | |
| 2,238,513 | * | 4/1941 | Ward . | |
| 3,121,907 | * | 2/1964 | Stebbins . | |
| 3,156,944 | | 11/1964 | Bohn . | |
| 3,391,674 | | 7/1968 | Burleigh . | |
| 3,648,411 | * | 3/1972 | Saunders et al. | 49/460 |
| 4,658,469 | | 4/1987 | Hawkins . | |
| 4,686,742 | | 8/1987 | Arnold . | |
| 4,710,634 | | 12/1987 | Brookes . | |
| 4,856,140 | | 8/1989 | Visco et al. . | |
| 5,511,284 | | 4/1996 | Current . | |

* cited by examiner

*Primary Examiner*—Anthony Knight
*Assistant Examiner*—Alison K. Pickard

(57) ABSTRACT

A sanitary opener with bumper for attachment to a door for use by an operator to open the door with his forearm or elbow is described. The opener comprises a first portion generally parallel to and for attachment to the door, a second portion extending away for the door, a third portion running generally parallel to the door and at a distance from the door and a fourth outer portion which serves as a bumper to prevent injury should an operator be struck by the opener. The bumper is formed by curving the outer portion and by positioning its free end to prevent operator exposure to sharp edges. To open the door, an operator places his forearm behind the third portion and pulls. A sanitary advantage is achieved since the operator's hands do not touch the door.

20 Claims, 7 Drawing Sheets

SANITARY DOOR OPENER WITH BUMPER

CROSS REFERENCE

This application is a continuation in part of U.S. Ser. No. 08/915,500, filed on Aug. 20, 1997 entitled SANITARY DOOR OPENER now U.S. Pat. No. 5,983,454 granted on Nov. 16, 1999.

FIELD OF THE INVENTION

This invention describes a sanitary door opener with bumper for use by an operator to open a door with his forearm or elbow.

BACKGROUND OF THE INVENTION

A door opener that does not require the use of an operator's hands offers a distinct sanitary advantage in hospitals and other medical facilities, in public restrooms and especially in restrooms of restaurants and other food service establishments where patrons do not want their hands to contact restroom doorknobs or handles.

Depending upon use, personnel doors are generally equipped with one of two types of handles: those with built-in latches to permit locking or those without positive latches. The present invention relates to those passage type doors and doors of cabinets and other enclosures which do not use positive latching means. Closure devices or tension type latches on doors do not interfere with use of the current opener.

Ideally, non-latching, passage doors that swing in two directions could be used in sanitary sensitive establishments so that a person's forearm, elbow or foot, rather than his hand, could be used to push a door open from either side; however, this is not advisable due to safety considerations. Building codes do not permit doors to be installed that swing outwardly into hallways or other common areas since a person in the hallway could be injured by the unexpected opening of a door. Unless a special alcove is constructed, most doors are installed to swing inwardly into a room. These doors can be pushed open only from their outward or passageway side; therefore some type of gripping device is required to open these doors from the inside.

Except for electronically operated doors which are expensive to install and maintain, no practical means for opening a passage door in a sanitary manner from its inwardly swinging side has been described in prior art. Consequently, a need exists for a safe, manually operated, sanitary, door opener that does not require the use of an operator's hand.

SUMMARY OF THE INVENTION

The present invention is that for a manually operated, sanitary door opener with bumper. The opener is designed for an operator's forearm or elbow to be used to open any non-latching personnel or cabinet door from its swinging side. Since an operator's hands are not required to contact a doorknob or handle, a distinct sanitary advantage is gained.

The preferred embodiment of the sanitary door opener with bumper comprises four portions all of which may be integrally formed plus an attachment means. A first portion fits against the door for attachment to the door. A second portion extends away from the door and a third portion runs generally parallel to, but offset from the door. In the preferred embodiment, the fourth portion is an outer bumper portion that extends from the free end of the third portion and is curved away from the plane of the door and then back toward the door. When an operator places his forearm or elbow behind the third portion and pulls, the door is opened fully or at least partially. At this time, the operator may remove his forearm or elbow from the opener and, if needed, reposition one of them, his shoulder, hip, knee or foot against the edge of the door for further opening. The operator's hands are not used.

A significant feature of the current invention is that a bumper is provided so that no potentially sharp end of the opener can cause injury to an operator. One end of the opener is secured flat against the surface of the door by the attachment means and the other end, the free end of the bumper, is inaccessible due to the curvature of the bumper. The primary concern for potential injury to an operator could arise from the unexpected opening of a door initiated by another operator on the opposite side of the door. The door could be pushed open at a high rate of velocity striking the operator on the inside.

In an alternate embodiment of the opener, the outer or bumper portion has a first end that extends from the free end of the third portion and is curved outwardly away from the door, a middle section that runs generally parallel to the plane of the door and a second curved end that turns toward the door. A return portion extends from the second end of the bumper and runs back toward the door. When an operator places his forearm behind the third portion and pulls, the door is opened without use of the operator's hands. The operator is again protected against potential injury by the bumper action of the outer portion.

DESCRIPTION OF THE PREFERRED EMBODIMENTS

Figure 1:
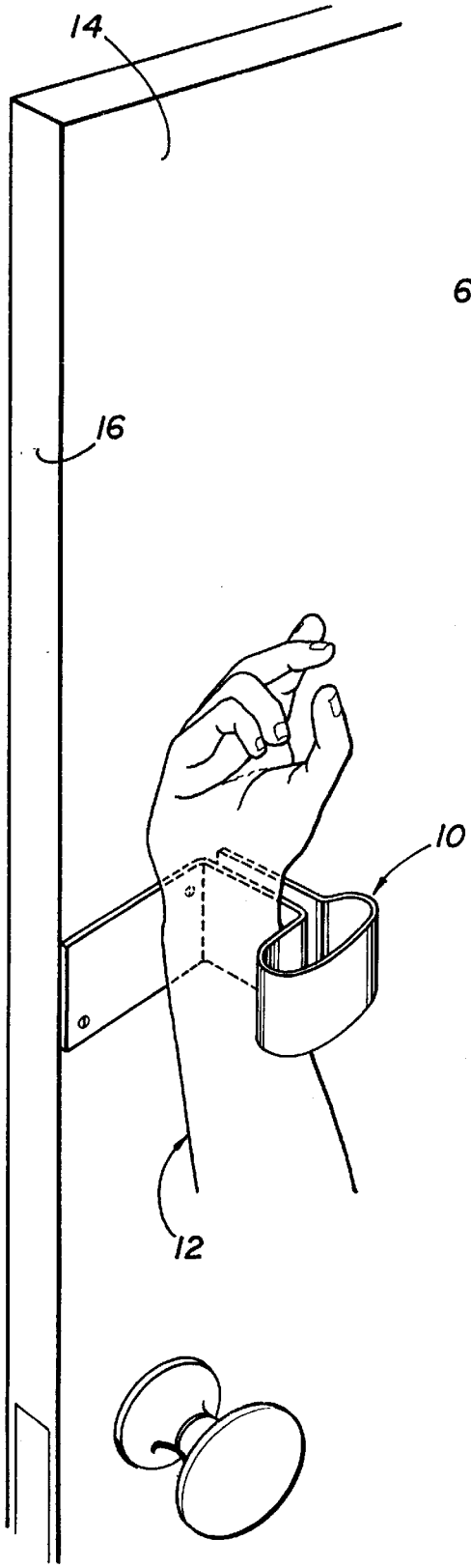
FIG. 1 is a perspective view of one embodiment of the sanitary door opener installed on a door and being operated by a person's forearm.
Figure 2:
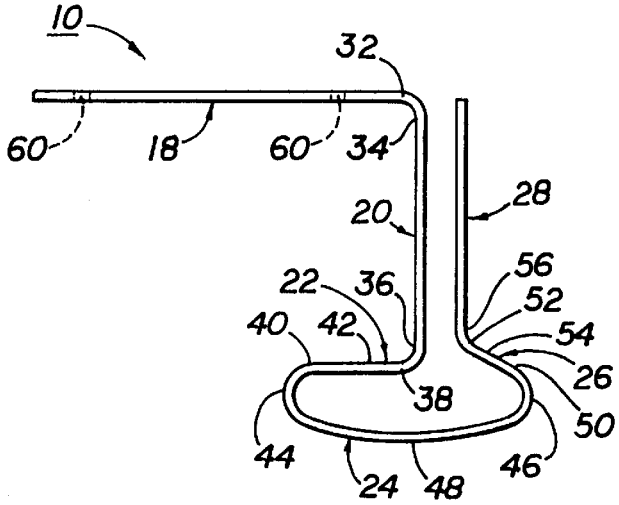
FIG. 2 is a top view of the embodiment shown in FIG. 1.
Figure 3:
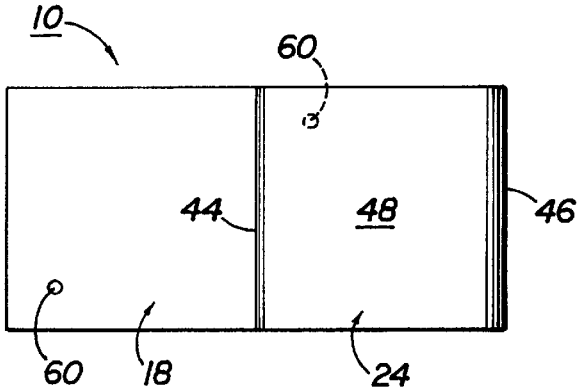
FIG. 3 is a side view from the front of the embodiment shown in FIG. 1.

FIGS. 1, 2 and 3 show one embodiment of the sanitary door opener 10 for use by an operator to manually open a door 14 using his forearm 12 or elbow. The opener is designed for attachment to the inward swinging side of a non-latching door at an appropriate height near its edge 16. The operator's hands are not required to open the door; therefore, a distinct sanitary advantage is gained. Where a sanitary need exists, the opener may also find use in opening doors of cabinets or other enclosures where the doors are held closed by tension type devices. The sanitary opener will find applications in hospitals and other medical facilities, in public restrooms and particularly in restrooms of restaurants and other eating establishments.

FIG. 1 shows a sanitary door opener 10 installed on a door 14 and being used by an operator to open the door using his forearm 12. The operator's hand does not contact any part of the door, doorknob or door handle.

FIGS. 2 and 3 show a top and front side view, respectively, of the opener 10. The opener is comprised of six portions, 18, 20, 22, 24, 26 and 28. All six portions may be integrally formed from a thin, flat, metal bar. The first portion 18 is oriented generally parallel to the door with one or more holes 60 in it for the passage of fasteners. A second portion 20 extends away from the door. A first end 34 of second portion 20 is connected to one end 32 of first portion 18. The third portion 22 with contact surface 42 extends generally parallel to the door. A first end 38 of third portion 22 is connected to a second end 36 of second portion 20.

To utilize the opener, an operator's forearm or elbow is placed behind third portion 22 and against contact surface 42. As the operator pulls, the door is opened. If the door opens only partially, the operator may choose to remove his forearm from the opener and reposition it against the edge of the door to complete the opening. Use of the operator's hands are still not required. As the door swings open, the operator's forearm 12 will tend to rotate against portions 20 and 22 of the sanitary opener. After the door is partially opened, the operator's forearm 12 will be in full contact with portion 20. For this reason, portion 20 should be sufficient in length to prevent the operator's hand, which is wider than his forearm, from accidentally contacting the door during this rotating process.

FIGS. 2 and 3 further show a fourth portion 24 of the sanitary opener 10 with curved ends 44 and 46 turning inwardly toward the door. One curved end 44 is connected to a second end 40 of third portion 22. The primary function of the fourth portion 24 is to serve as a safety bumper across the front of the opener to protect an operator should the door unexpectedly be pushed open from the opposite side. The curved ends 44 and 46 and a slightly bowed mid section 48 of fourth portion 24 further serve to prevent injury should the opener accidentally strike the operator. Additionally, a cover with rounded edges (FIGS. 14 and 15) over the top and bottom of the sanitary opener 10 may also be utilized to improve safety.

Also shown in FIGS. 2 and 3 is a fifth portion 26 which runs at an angle to the plane of the door and has a contact surface 54. A first end 50 of fifth portion 26 is connected to curved end 46 of fourth portion 24. A sixth portion 28 with a curved end 56 connected to a second end 52 of fifth portion 26 extends back toward the door. Portions 26 and 28, like portions 20 and 22, permit gripping the opener by the use of an operator's forearm but from the opposite side of the opener. When an operator places his forearm against contact surface 54 and pulls, the door opens. When using this side of the opener, the operator's forearm tends to rotate along fifth portion 26 and curved end 46 of fourth portion 24 as the door swings open. This causes the operator's forearm to move further away from the door. Consequently, there is little likelihood his hand will accidentally contact the door.

Figure 9:
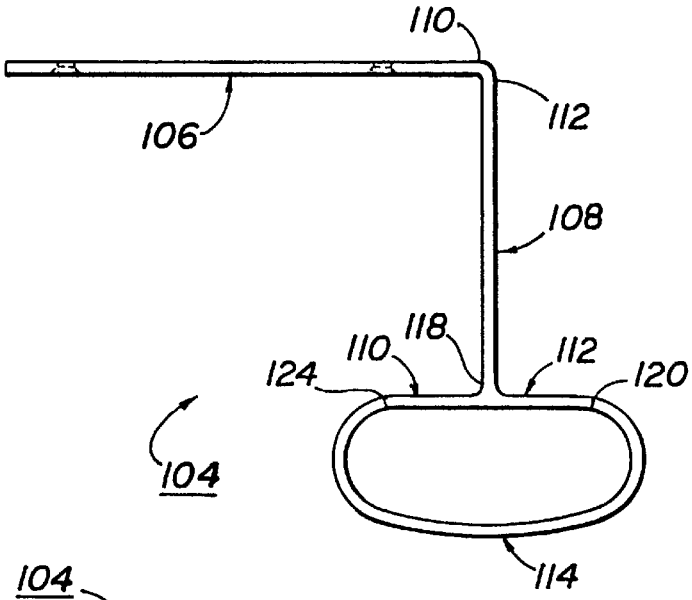
FIG. 9 is a top view of another embodiment of the sanitary door opener which is operated by a person's forearm.
Figure 10:
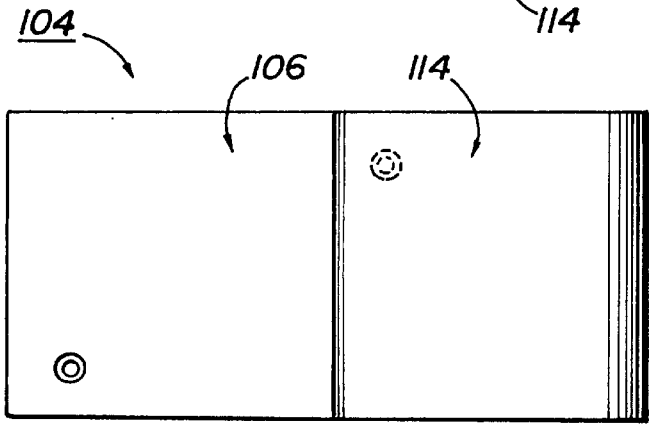
FIG. 10 is a side view from the front of the embodiment shown in FIG. 9.

FIGS. 9 and 10 show another embodiment of this invention. This embodiment is similar to that shown in FIGS. 1, 2 and 3 except that sixth portion 28 is eliminated and second end 52 of fifth portion 26 is connected to second end 36 of second portion 20. As FIGS. 9 and 10 show, this embodiment consists of portions 106, 108, 110, 112 and 114. This embodiment is simpler to construct than the embodiment of FIGS. 1, 2 and 3; however, an operator's forearm will not rotate quite as easily along portion 112 as with the previously described embodiment. To simplify construction, a vertically oriented section of tubing or rod may be substituted for portions 110, 112 and 114. When this is done the tubing or rod must be connected to second end 118 of portion 108 such as by welding.

Another embodiment of this invention comprises only portions 106, 108, 110 and 112 of opener 104. Construction is simplified even further with this embodiment; however, ends 124 and 120 of portions 110 and 112, respectively, would not be as rounded as with opener 104 thereby causing more of a safety concern if one end unexpectedly struck an operator. As with the other embodiments, an operator's forearm can be used on either side of the opener to pull the door open.

To position the contact surfaces of any of the embodiments at an orientation closer to the natural angle of a person's forearm, any surface against which an operator's forearm or elbow may pull may be oriented such that the portion and its surface are at an angle to the plane of the door. The lower edge of the portion would be farther from the door surface than the top edge.

Figure 4:
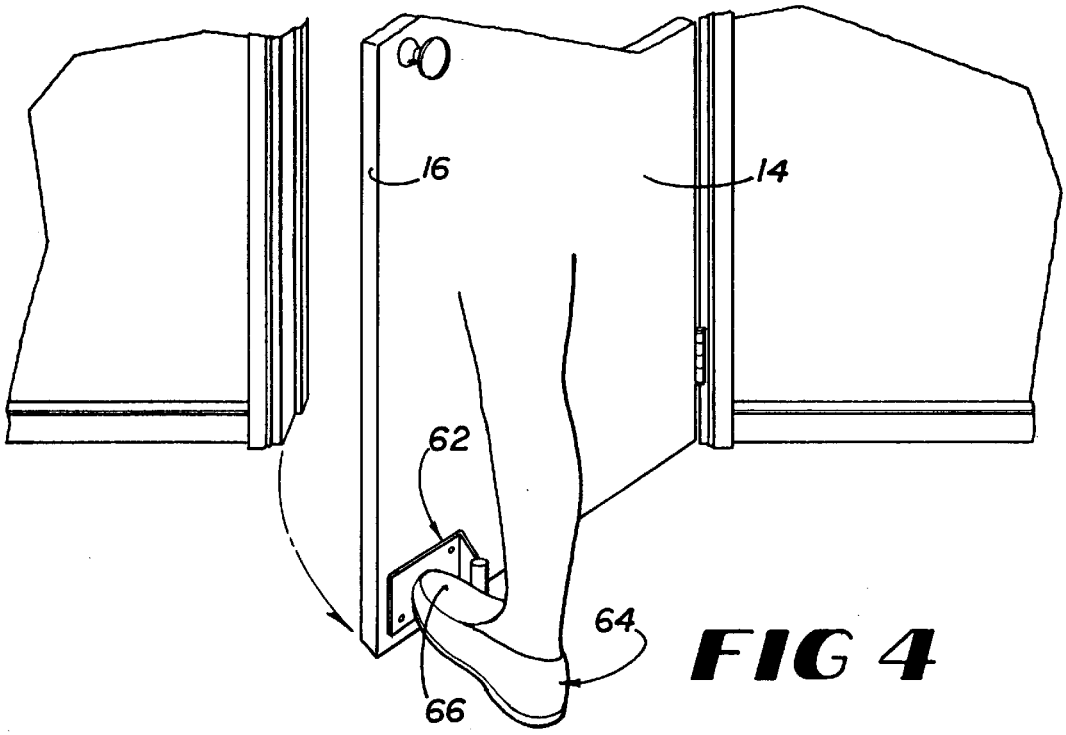
FIG. 4 is a perspective view of another embodiment of the sanitary door opener being operated by a person's foot.
Figure 5:
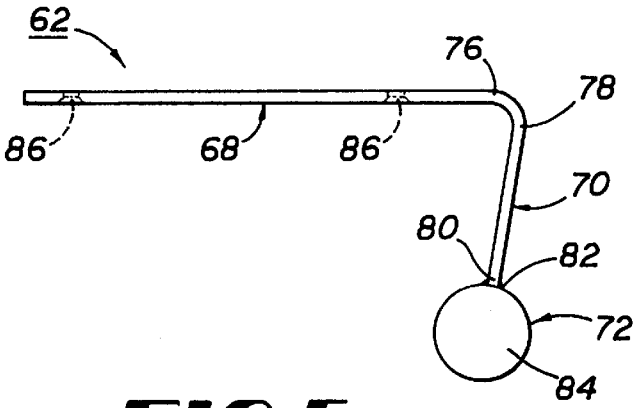
FIG. 5 is a top view of the embodiment shown in FIG. 4.
Figure 6:
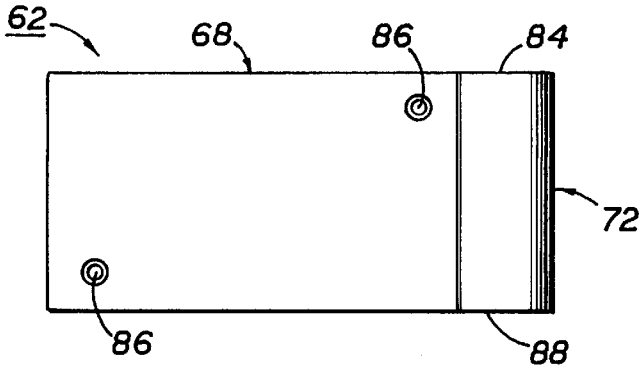
FIG. 6 is a side view from the front of the embodiment shown in FIG. 4.

FIGS. 4, 5 and 6 show an embodiment 62 of the sanitary door opener which is foot operated; it is comprised of three portions 68, 70 and 72. A first portion 68 of this embodiment is a generally planar member which attaches to a door 14 by the use of fasteners through holes 86. A second portion 70, also generally planar, extends away from the door at a slight angle. A first end 78 of the second portion connects to one end 76 of the first portion. A second end 80 of second portion 70 connects to third portion 72 which is a short, vertically oriented section of rod with a generally flat top 84 and flat bottom 88. One side 82 of the rod section is connected to second portion 70. The primary function of portion 72 is to assist the gripping of the opener by the toe of an operator's shoe. Construction of this embodiment may comprise a thin, flat, metal bar that is formed to make portions 68 and 70 and a short section of metal rod or tubing to make portion 72; metal portions 68 and 70 may be connected by welding. To open a door using this embodiment, the toe 66 of an operator's shoe 64 is placed firmly against portions 70 and 72 and pulled away from the door with a general rotation of his foot. The door will open fully or at least sufficiently for the door edge to become clearly accessible. At this point, the operator's foot may be removed from the opener and immediately repositioned against the lower part of door edge 16 for further opening.

Figure 7:
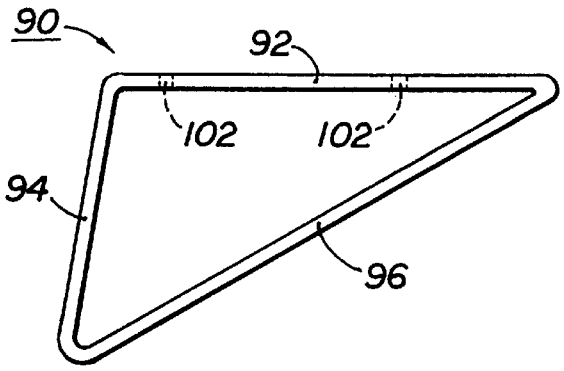
FIG. 7 is a top view of another embodiment which is also foot operated.
Figure 8:
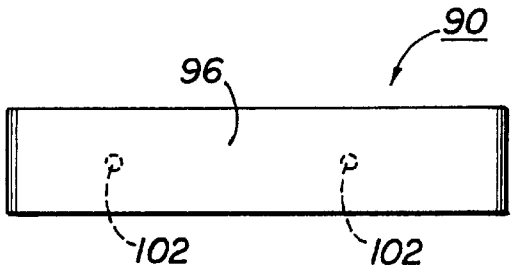
FIG. 8 is a side view from the front of the embodiment shown in FIG. 7.

FIGS. 7 and 8 show another embodiment 90 of this invention, which is also foot operated and identical in function and operation to opener 62. Its construction, however, is different. This embodiment 90 comprises three connecting sides, 92, 94 and 96. Side 92 fits against the door while side 94 extends outwardly from the door at a small angle thereby providing a contact surface for the toe of an operator's shoe. To improve gripping, side 94 may be designed with vertical groves in its surface or it may be covered with a grip enhancing material. Holes 102 extend through side 92 to provide a passage for fasteners. The opener may be constructed from thin, flat, metal bar that is formed to the appropriate shape and whose ends are connected. This embodiment may also be constructed from a solid block of wood, metal, plastic or other material.

Figure 11:
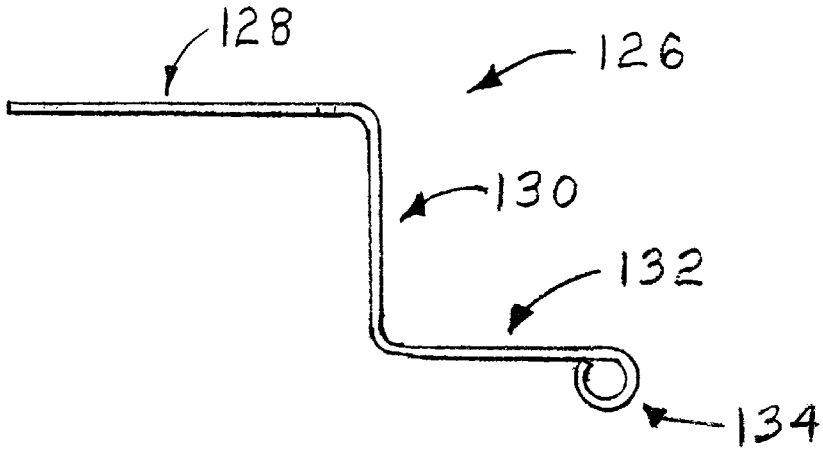
FIG. 11 is a top view of another embodiment with bumper which is operated by a person's forearm.
Figure 12:
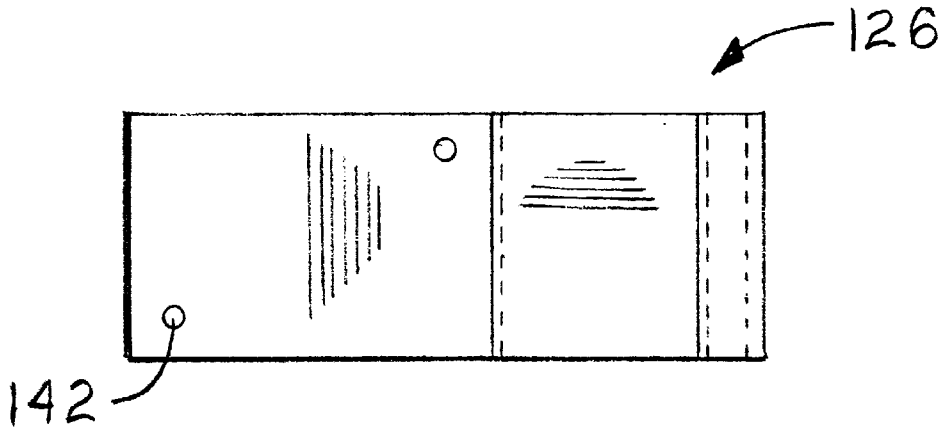
FIG. 12 is a side view from the front of the embodiment shown in FIG. 11.

FIGS. 11 and 12 show a top and side view, respectively, of an embodiment 126 of the sanitary door opener that is operated by a person's forearm or elbow. This embodiment comprises a first portion 128 that is for attachment to the door using fasteners which pass through holes 142. A second portion 130 extends away from the door and a third portion 132 extends generally parallel to, but offset from, the door and has a contact surface on the side facing the door. The third portion is offset at a sufficient distance from the door for an operator's forearm or elbow to fit between this portion and the door. An outer portion 134 extends from the end of the third portion, is curved away from the third portion 132 and then back toward third portion 132. Outer portion 134 is curved sufficiently so that its free end is not accessible to contact an operator.

A significant feature of the current invention, including the embodiment shown in FIGS. 11 and 12, is that no potentially sharp end of the opener is arranged in a position that could cause injury to an operator. One end of the opener is secured flat against the door by an attachment means and the other end, the free end of the outer portion, is inaccessible due to the curvature of the outer portion. The primary concern for potential injury to an operator could arise from the door's being unexpectedly pushed open by an operator on the other side of the door. The door could be pushed open at a high rate of speed likely striking the operator on the inside at chest or head level.

Figure 13:
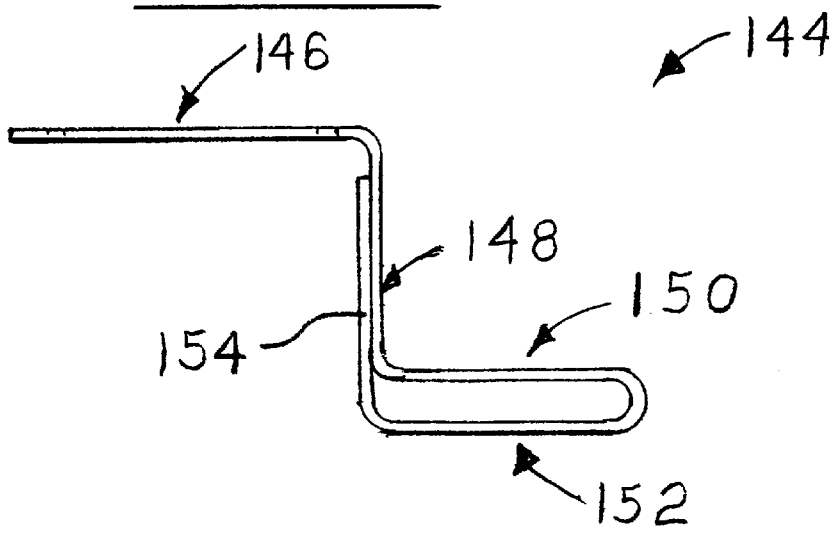
FIG. 13 is a top view of another embodiment with bumper which is operated by a person's forearm.

FIG. 13 is a top view of another embodiment 144 that is operated by a person's forearm or elbow. This embodiment consists of five portions, 146, 148, 150, 152 and 154. As with the previously described embodiment, first portion 146 fits against the door, second portion 148 extends away from the door, and third portion 150 runs generally parallel to the door and has a contact surface on the side facing the door. In this embodiment, however, the outer "bumper" portion 152 has a first curved end that extends from the end of third portion 150, a middle section that runs generally parallel to the third portion and a second curved end that curves toward the door. A return portion 154 extends back toward the door. Safety is once again the primary function of the outer portion. It prevents a potentially sharp end of third portion 150 from injuring an operator. Return portion 154 likewise prevents the second end of the outer portion from causing injury. The middle section of the outer portion may be curved outwardly away from the door to further improve safety. Another safety feature of opener 144 is that outer portion 152 and return portion 154, if constructed from a material of appropriate thickness and elasticity, are free to move or "flex" slightly should the bumper strike an operator. This "flex" capability should further reduce the potential for serious injury to an operator that is struck. If desired, however, portion 154 could be connected to portion 148 by an attachment means, such as a screw and nut, welding, a rivet, a brad, an adhesive material or any other suitable means.

Figure 19:
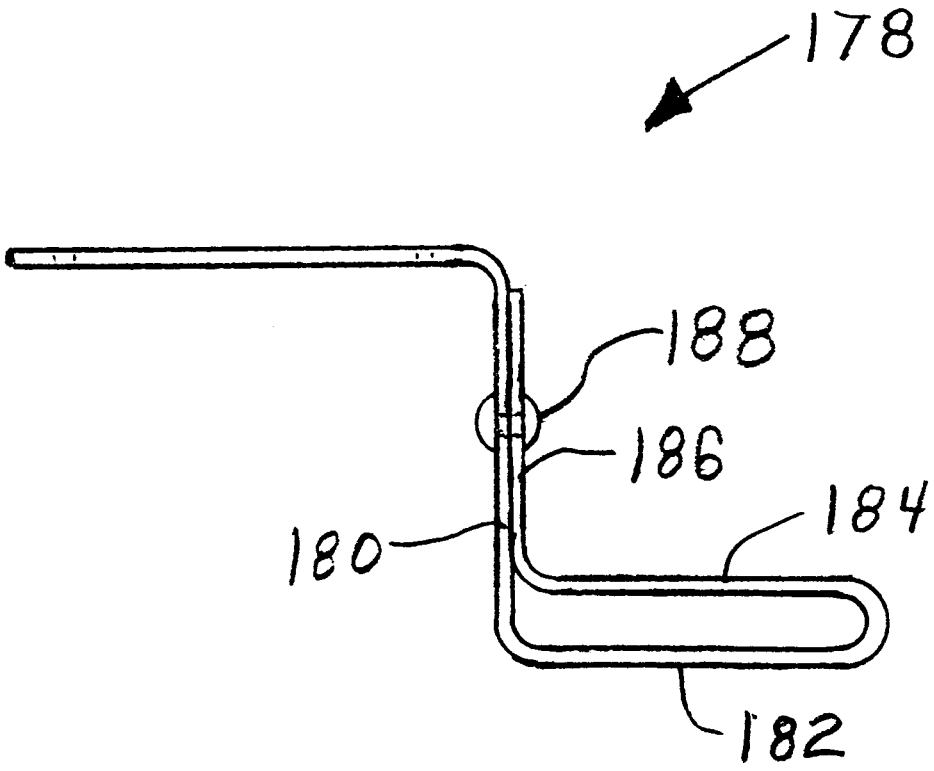
FIG. 19 is a top view of another embodiment with bumper that is very similar to that shown in FIG. 13, which is operated by a person's forearm.

FIG. 19 shows another embodiment of a forearm or elbow operated sanitary door opener that is very similar to the embodiment of FIG. 13. In the opener 178 of FIG. 19, the outer portion 184 is reversed to turn toward the plane of the door. Said outer portion 184 has a first curved end that extends from third portion 182, a middle section with a contact surface facing the door, and a second curved end that turns toward the door. Return portion 186 extends from the second curved end of the outer portion and runs toward the door. A fastener, 188, may be used to connect the return portion to second portion 180 for improved fit and added stability. Again, the outer portion has a curved end extending from the free end of the third portion 182 to act as a safety bumper and prevent injury.

FIGS. 13 and 19 are examples, which show that the safety bumper portions of the forearm or elbow operated embodiments of the present invention, may be curved either "away from" or "toward" the door. The bumper portion 152 of FIG. 13 curves away from the door while the bumper portion 184 of FIG. 19 curves toward the door.

Likewise, the first portion of each forearm or elbow operated embodiment of the present invention may be formed to face "away from" or "toward" the edge of the door. For example, in FIGS. 1 and 2 first portion 18 extends toward the edge of the door forming somewhat of a shape with second portion 20 and third portion 22 which also faces toward the edge of the door. It should be understood that the first portion 18 may extend in the opposite direction so that it faces away from the edge of the door. In this configuration, the first and third portions extend in opposite directions as illustrated in FIG. 11.

Figure 16:
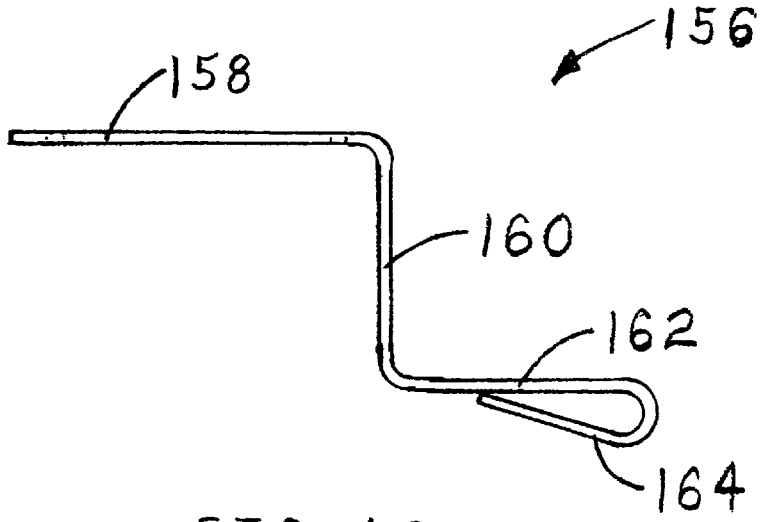
FIG. 16 is a top view of another embodiment with bumper which is operated by a person's forearm.

FIG. 16 describes an embodiment 156 comprising first portion 158, second portion 160, third portion 162 and outer portion 164. The outer or safety bumper portion has a first end that is curved and extends from the free end of the third portion 162 and further has a second end that is generally straight and extends back toward the third portion. The free end of the outer portion rests alongside the third portion and therefore cannot inflict injury.

Figure 17:
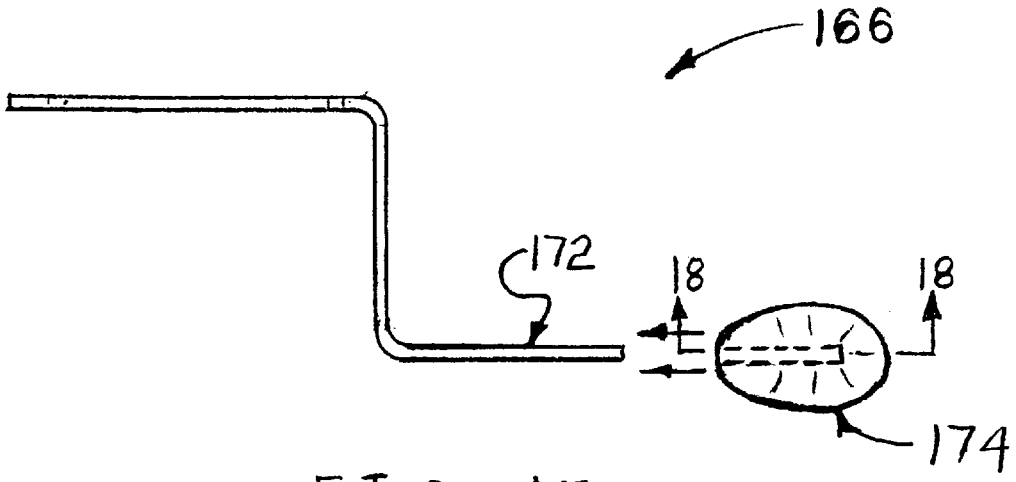
FIG. 17 is a top view of still another embodiment which is operated by a person's forearm.
Figure 18:
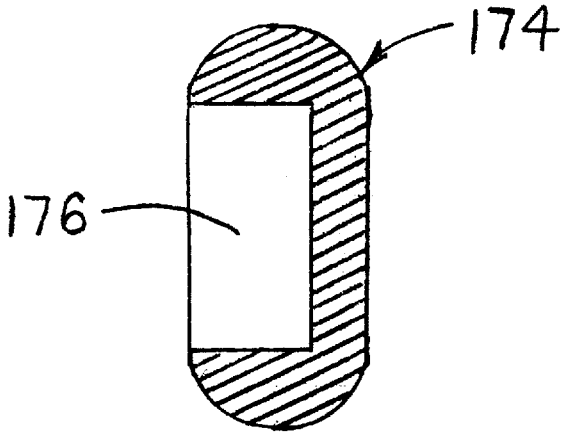
FIG. 18 is a section view taken along section line 18 of the bumper cap shown in FIG. 17.

FIGS. 17 shows a top view of another embodiment 166 of the sanitary door opener that is operated by a person's forearm or elbow. FIG. 18 shows a cross sectional view of a bumper cap 174 which is formed with a slot 176 to slip over the potentially sharp free end of third portion 172. Exterior surfaces of the bumper cap are generally rounded to prevent injury. The bumper cap may be secured to portion 172 by a tight fit, by an adhesive or by an attachment means such as a screw and nut, a rivet, a brad or other equivalent means. The function of the bumper cap is to cover the potentially sharp free end of third portion 172 to prevent potential injury to an operator.

Figure 14:
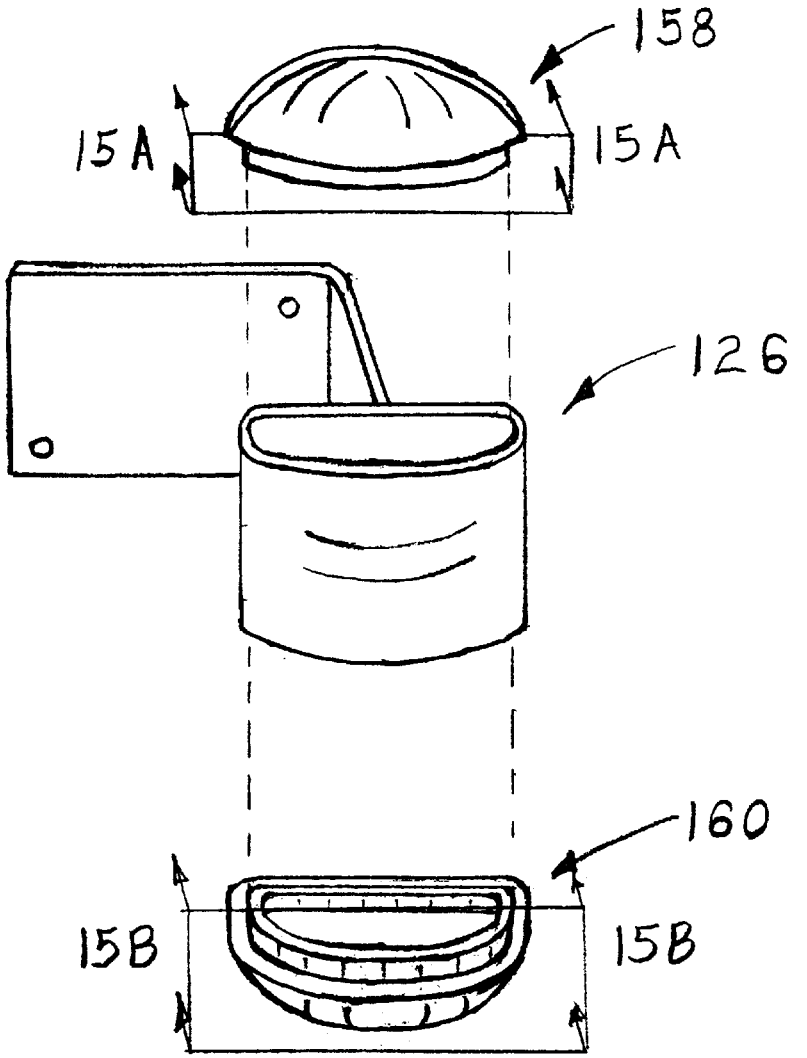
FIG. 14 is a perspective view of a top cap and a bottom cap aligned for installation on the opener shown in FIG. 9.

FIG. 14 shows a top cap 158 and a bottom cap 160 ready for installation on a sanitary door opener. In this figure, the caps are formed for opener 126; however, this is for illustration only. The caps may be used on any of the embodiments of the current invention that are operated by a person's forearm or elbow. Due to the shape of the opener, a top opening and a bottom opening are formed. In other embodiments, the openings are present in different shapes. The purpose of the top and bottom caps is to offer further safety protection to prevent injury to an operator should any edges of the opener including the top and bottom edges unexpectedly strike him.

Figure 15A:
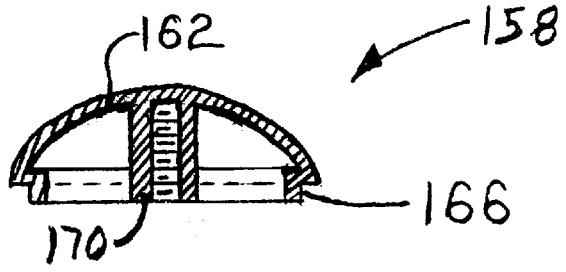
FIG. 15A is a section view taken along section plane 15A of the top cap shown in FIG. 14.
Figure 15B:
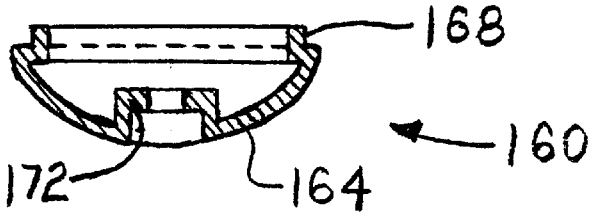
FIG. 15B is a section view taken along section plane 15B of the bottom cap shown in FIG. 14.

FIGS. 15A and 15B are section views of the top cap 158 and bottom cap 160, respectively, shown in FIG. 14. Edges 166 and 168 are recessed to fit inside the top and bottom opening of the opener to hold the caps in their preferred positions. A recess 172 in the bottom cap is provided for the head of a fastener, such as a screw, pin, rivet, brad or equivalent attachment means. A complimentary screw boss 170 is shown in the top cap. The caps may be hollow with walls such as 162 and 164 or they may be solid. The caps may be made of a rigid or a semi-flexible or flexible material. In all cases, the cap is formed to have a rounded or curved outside surface that would not cause injury if an operator were struck. The primary benefit of the caps is to cover the top and bottom edges of the opener and thereby prevent them from causing injury.

While several embodiments of the present invention have been shown in the drawings and described herein, such is for exemplary purposes only and the invention is limited only by the scope and spirit of the appended claims

What is claimed is:

1. An opener for attachment to a vertical surface of a swinging door for use by an operator to open the door using the operator's forearm or elbow comprising:

a. a first portion for attachment to the surface of the door, b. an attachment means for attaching said first portion to the door, c. a second portion extending away from said first portion, d. a third portion extending away from said second portion, wherein said third portion has a contact surface oriented generally facing a plane of said first portion, wherein said plane is generally parallel to a plane of the door wherein said third portion extends from said second portion at a distance from the plane of said first portion, the distance being sufficient to allow the forearm of an operator to be inserted between said third portion and the plane of said first portion and placed against said contact surface of said third portion, and e. an outer portion extending from the free end of said third portion, wherein said outer portion is curved to serve as a bumper to prevent potential injury to the operator when the door is opened.

2. The opener in claim 1 wherein said outer portion is first curved away from said third portion and then curved toward said third portion.

3. The opener in claim 2 wherein said outer portion is shaped to define a top opening and a bottom opening and wherein said opener further comprises a top cap and a bottom cap which cover the top and bottom openings, respectively.

4. The opener in claim 1 wherein said outer portion is first curved outwardly away from the plane of said first portion and then curved inwardly toward said third portion.

5. The opener in claim 4 wherein said outer portion is shaped to define a top opening and a bottom opening and wherein said opener further comprises a top cap and a bottom cap which cover the top and bottom openings, respectively.

6. The opener in claim 1 wherein said outer portion has a first end that is curved away from said third portion and a second end that extends back toward said third portion.

7. The opener in claim 6 wherein said outer portion is shaped to define a top opening and a bottom opening between said outer portion and said third portion and wherein said opener further comprises a top cap and a bottom cap which cover the top and bottom openings, respectively.

8. The opener in claim 1 wherein said outer portion has a first end that is curved outwardly away from the plane of said first portion, a middle section that extends generally parallel to said third portion and a second end that is curved inwardly toward said first portion.

9. The opener in claim 8 further comprising a return portion extending from said second end of said outer portion and extending toward said first portion.

10. The opener in claim 9 further comprising an attachment means for attaching said return portion to said second portion.

11. The opener in claim 8 wherein said outer portion is shaped to define a top opening and a bottom opening between said outer portion and said third portion and wherein said opener further comprises a top cap and a bottom cap which cover the top and bottom openings, respectively.

12. The opener in claim 8 wherein said middle section is curved outwardly away from said third portion.

13. The opener in claim 1 wherein said outer portion comprises a bumper cap which fits over the free end of said third portion.

14. The opener in claim 1 wherein said third portion has an upper edge and a lower edge wherein said lower edge is spaced apart from the plane of the door at a greater distance than said upper edge.

15. An opener for attachment to a vertical surface of a swinging door for use by an operator to open the door using the operator's forearm or elbow comprising:

a. a first portion for attachment to the surface of the door, b. an attachment means for attaching said first portion to the door, c. a second portion extending away from said first portion, d. a third portion extending away from said second portion, wherein said third portion extends in a direction generally parallel to the plane of said first portion, and e. an outer portion extending from the free end of said third portion, wherein said outer portion has a first end that is curved inwardly toward the plane of said first portion, a middle section that extends in a direction generally parallel to the plane of said first portion, and a second end that is curved inwardly toward the plane of said first portion, wherein said middle section has a contact surface generally facing toward the plane of said first portion, and wherein said middle section is located at a distance from the plane of said first portion, the distance being sufficient to allow the forearm of an operator to be inserted between said middle section of said outer portion and the plane of said first portion and placed against said contact surface of said middle section.

16. The opener in claim 15 further comprising a return portion extending from said second end of said outer portion and extending toward the plane of said first portion.

17. The opener in claim 16 further comprising an attachment means for attaching said return portion to said second portion.

18. The opener in claim 15 wherein said outer portion is shaped to define a top opening and a bottom opening between said outer portion and said third portion and wherein said opener further comprises a top cap and a bottom cap which cover the top and bottom openings, respectively.

19. The opener in claim 15 wherein said outer portion is at an angle to the plane of the door.

20. The opener in claim 15 wherein said third portion is curved outwardly away from the plane of said first portion.

* * * * *